US009040794B1

(12) United States Patent
Nagahara

(10) Patent No.: US 9,040,794 B1
(45) Date of Patent: May 26, 2015

(54) PICCOLO

(71) Applicant: Kanichi Nagahara, Chelmsford, MA (US)

(72) Inventor: Kanichi Nagahara, Chelmsford, MA (US)

( * ) Notice: Subject to any disclaimer, the term of this patent is extended or adjusted under 35 U.S.C. 154(b) by 0 days.

(21) Appl. No.: 14/307,935

(22) Filed: Jun. 18, 2014

(51) Int. Cl.
*G10D 7/02* (2006.01)

(52) U.S. Cl.
CPC ..... *G10D 7/026* (2013.01)

(58) Field of Classification Search
CPC ..... G10D 7/026
See application file for complete search history.

(56) References Cited

U.S. PATENT DOCUMENTS 1,376,004 A * 4/1921 Christensen ..... 84/384
4,714,000 A * 12/1987 Braun ..... 84/384
6,259,010 B1 * 7/2001 Nagahara ..... 84/380 R
7,589,268 B2 * 9/2009 Keefe et al. ..... 84/384
8,389,840 B2 * 3/2013 Braun ..... 84/384

* cited by examiner

*Primary Examiner* — Robert W Horn
(74) *Attorney, Agent, or Firm* — Lambert & Associates; Gary E. Lambert; David J. Connaughton, Jr.

(57) ABSTRACT

A piccolo comprising a conical-bore headjoint, and a cylindrical-bore main body having toneholes of particular size disposed at particular intervals along the length of the body.

4 Claims, 2 Drawing Sheets

PICCOLO

BACKGROUND OF THE INVENTION

1. Field of the Invention

The present invention relates generally to piccolo devices. More particularly the present invention relates to a piccolo comprising a conical-bore headjoint, and a cylindrical-bore main body having toneholes of particular size disposed at particular intervals along the length of the body.

2. Description of Related Art

Instrument makers mean by an instrument's "scale" the particular lengthwise arrangement of the toneholes along the length of an instrument's tubular body. This term can also include the size of the various toneholes. Further, the term "scale" can encompass the size and shape of an instrument's bore. While the acoustical mathematics of rudimentary instruments have been known since ancient times, the fact is that the human ear does not always consider mathematically correct pitches to be in tune, depending on the musical context in which they are heard. Also, a strict mathematical arrangement of toneholes would only provide an equal "temperament" of pitches throughout a single octave—the pitches in the next octave would be out of tune due to the acoustical properties of any particular instrument tube, whether conical or cylindrical, closed-end or open-end.

In order to address this problem, instrument makers have developed various schemes of tonehole and bore arrangements, which typically involve varying the position of the toneholes along the length of the instrument, as well as increasing or decreasing the size of the various toneholes according to whim, or employing a conical rather than cylindrical bore shape. The result is an instrument of compromises—in order for the pitches throughout the range of the instrument to be in tune, certain sacrifices must be made to the perfect layout of the lower octaves, for example- and it is generally accepted to be the responsibility of the performer to manage these compromises to achieve a musically pleasing result.

Now, as individual performers vary greatly in their abilities and physical characteristics (lip & tongue shape or breath capacity, for example), instrument makers have developed their particular "scales" according to their own (and their clients') various hypotheses regarding what compromises performers can be expected "to put up with" in order to perform their musical duties. By way of example, the size of the $C\#^5$ tonehole was drastically reduced in Theobald Boehm's flute scale, and its location altered, in order to effect the correct pitch for the note $D^6$; consequently, $C\#^5$ is well-known for having poor tone color, and is thus given particular attention in the training of a professional flutist.

The result is that most major manufacturers of flutes today consider their "scale" to be an integral feature of their brand identity, and flutists give "scale" the same, if not more, consideration as feel, material, and quality when choosing an instrument.

The piccolo, in contrast to the flute, has not seen the same evolution in "scale" as has the flute. This is partially due to the small size of the traditional conical bore of the piccolo-11.0 mm at maximum. This leaves little room for tonehole size variation. In addition, the fact that the traditional piccolo tube decreases in diameter towards the end opposite the embouchure hole further restricts the piccolo maker's choices.

Though piccolos and flutes are commonly considered "cylindrical" bore instruments, they both have central bores that in fact vary slightly in diameter, i.e. the bores are tapered. It was realized by early flute makers that a more optimum intonation of the upper octaves could be achieved by the introduction of a headjoint with a tapered bore, while the main body and footjoint of a flute remained strictly cylindrical. The internal diameters of the flute and piccolo have remained at 19.0 mm and 11.0 mm respectively, have not changed in over a hundred years, and are generally accepted to be unchangeable standards.

There are currently two types of piccolo bores available, both with a maximum diameter of 11.0 mm, which are those with a cylindrical body and conical headjoint, as with the flute, and those with a conical body and cylindrical headjoint. The latter is by far the most popular among professional musicians, the tapered head of the former being too small a diameter to produce a quality sound in the middle and low registers. While the conical bore piccolo's headjoint is large enough to produce the desired tone, the conical-bore piccolo suffers from poor tone hole ventilation (due to the 11.0 mm diameter), which produces a "small" sound that is relatively inflexible with regard to tone color and dynamics as compared with the flute. In addition, the preferred taper for the main body limits its length, which prevents the extension of the piccolo's range from the current "low-D" down to "low-C" and "-B", as is seen on the larger flute. This limits the performance repertoire available to the piccolo player, as the player would not be able to play any note below the note "low-D" which may be written for the flute. Also, the extra body length afforded by these low notes on the flute assists in the acoustics of the extreme upper register. This extra length, and the accompanying advantages, is not, as mentioned above, available on the conical-bore piccolo today. Metal cylindrical-bore piccolos indeed have a headjoint long enough for the proper taper, but the taper starts from 11.0 mm, the result of which is a minimum diameter which is too small to produce the best tone.

There exist, particularly in piccolos made of metal, previous cylindrical-bore designs which attempt to include a footjoint section, extending the lower range as described above. However, these designs have retained the maximum bore size of 11.0 mm, and as a consequence still produce a less than optimum tone. The reason for not exceeding the traditional 11.0 mm diameter bore is that the necessarily larger toneholes accompanying an enlarged bore would be covered in turn by larger keys which would crowd in upon each other.

Therefore, what is needed is a piccolo scale that is capable of producing the full complement of notes and tones as would be afforded by that of the modern flute scale. The present invention addresses all of the inherent design problems discussed above and in the course of doing so encompasses aspects of an improved piccolo scale that will offer the player a wider range of control over pitch, volume and tone color, as well as an increased selection of performance repertoire, as traditional piccolos often are incapable of playing flute music due to their limited range.

SUMMARY OF THE INVENTION

The subject matter of this application may involve, in some cases, interrelated products, alternative solutions to a particular problem, and/or a plurality of different uses of a single system or article.

A significant component of the present invention is an enlarged cylindrical bore in the main body section, specifically redesigned for piccolos. An enlarged cylindrical bore offers the player several acoustic advantages over the traditional design, such as better tone control, a wider range of sound volume (dynamics), improved intonation, and more flexibility to produce artistic nuances in musical performance. Another advantage of a cylindrical bore is that the length of the piccolo can be increased without the detrimental effects realized in the conical-bore or 11.0 mm designs. The practical application with regard to the present invention is the addition of a "footjoint" section in some embodiments, which adds three notes (C#, C and B) to the lower register of the piccolo. In addition to the obvious benefit of increased repertoire as described above, the top registers of the piccolo benefit acoustically from the increased length of tubing.

It is therefore an object of the present invention to provide an improved piccolo scale having a bore with an enlarged cylindrical section in the body for better intonation and flexibility of tone and dynamics.

It is a further object of the present invention to provide a piccolo with enlarged toneholes for improved intonation and ventilation.

It is a further object of the present invention to provide an improved piccolo having an optimized scale for enhanced intonation, sound, and playing flexibility.

DETAILED DESCRIPTION

Figure 1:
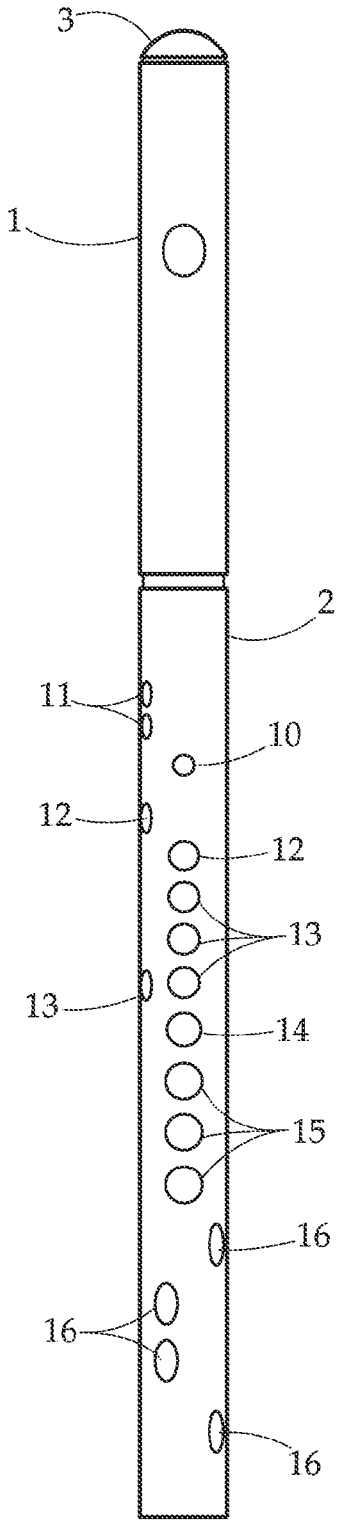
FIG. 1 provides an elevation of an embodiment of the piccolo contemplated herein.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns an improved piccolo and piccolo-type instruments having an improved bore and "scale", which is the tonehole configuration. The improved scale contemplated herein allows the performer to attain better intonation and a fuller, richer sound.

The piccolo contemplated herein comprises a body section having a cylindrical bore there through. The cylindrical bore through the body section is centered about and coincident with a longitudinal axis of the piccolo and is substantially uniform in diameter (allowing for minor deviations caused during manufacturing, material and machining properties, among other things) throughout the entirety of said body section. In one embodiment, the bore may be between approximately 11.3 mm and 11.9 mm in diameter.

The piccolo further comprises a headjoint having a conical bore there through. The conical bore through the headjoint is centered about and coincident with the longitudinal axis of the piccolo. The concical bore has a varied diameter from a widest diameter equal to the diameter of the body section's cylindrical bore at one end of the headjoint that reduces to a diameter less than the diameter of the cylindrical bore of the body section at other end of the headjoint. The longitudinal axis of the headjoint and the longitudinal axis of the body section are aligned and engaged such that the end of the headjoint having a conical bore diameter equal to the diameter of said body section cylindrical bore are connected and in communication with one another.

The piccolo contemplated herein is configured and based around a concert pitch of $A^4$=442 Hz. In one embodiment, the piccolo is configured having an additional footjoint beyond the end of where a traditional piccolo would stop, to provide a range of the instrument from between $B^5$ to $D\#^7$.

A significant component of the present invention is an enlarged cylindrical bore in the main body section, specifically redesigned for piccolos. In one embodiment, as noted above, the cylindrical bore may have a diameter of 11.3-11.9 mm, which is greater than the traditional bore diameter of 11 mm. An enlarged cylindrical bore offers the player several acoustic advantages over the traditional design, such as better tone control, a wider range of sound volume (dynamics), improved intonation, and more flexibility to produce artistic nuances in musical performance. Another advantage of a cylindrical bore is that the length of the piccolo can be increased without the detrimental effects realized in the conical-bore or 11.0 mm designs. The practical application with regard to the present invention is the addition of a "footjoint" section, which adds three notes (C#, C and B) to the lower register of the piccolo. In addition to the obvious benefit of increased repertoire as described above, the top registers of the piccolo benefit acoustically from the increased length of tubing.

Turning now to FIG. 1, a view of an embodiment of the piccolo contemplated herein is provided. The piccolo comprises a body 2 having a cylindrical bore as described above, and a plurality of toneholes 11-16 oriented thereon. A headjoint 1 is removably connected to the body 2. As noted above, the headjoint 1 has a conical bore, with the larger diameter end of the bore aligning with the cylindrical bore of the body 2. The headjoint 1 further defines the embouchure through which air enters from a player. A stopper 3 having an adjustable seal is provided to facilitate fine tuning.

Figure 2:
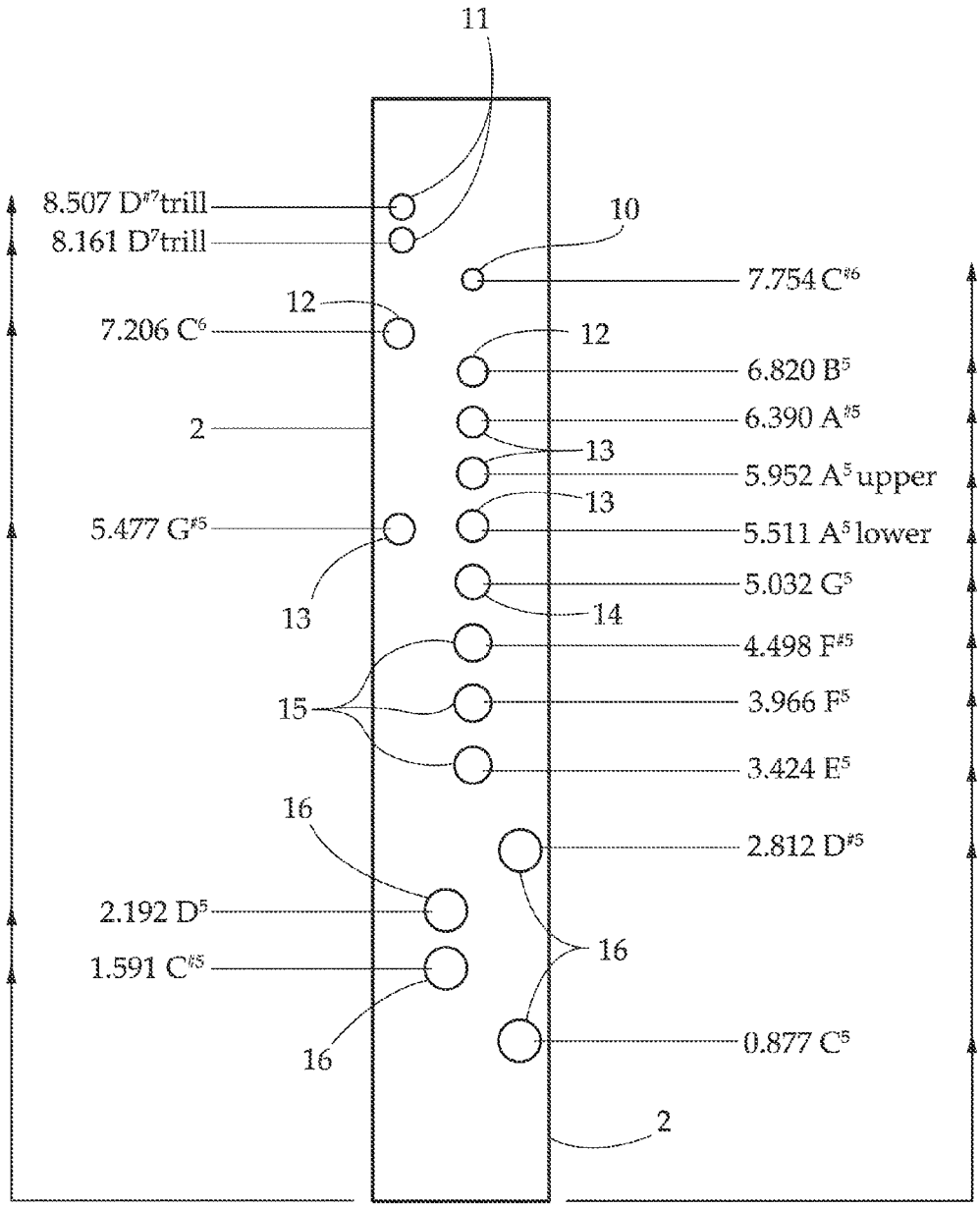
FIG. 2 provides a detail view of a body portion of an embodiment of the piccolo contemplated herein.

Referring to the embodiment shown in FIG. 2, the piccolo may have a scale providing a range from between $B^5$ to $D\#^7$ having the following tonehole positions on the piccolo body 2, as measured from the lower end of the tube to the tonehole center, in inches:

$D\#^7$ trill-8.507
$D^7$ trill-8.161
$C\#^6$-7.754
$C^6$-7.206
$B^5$-6.820
$A\#^5$-6.390
$A^5$ upper-5.952
$A^5$ lower-5.511
$G\#^5$-5.477
$G^5$-5.032
$F\#^5$-4.498
$F^5$-3.966
$E^5$-3.424
$D\#^5$-2.812
$D^5$-2.192
$C\#^5$-1.591
$C^5$-0.877

In one embodiment, these positions may have a deviation of +/−0.020 inches. This tonehole positioning has been established to provide an optimal feel and sound for a player.

Moreover, as also shown in FIGS. 1 and 2, the toneholes of the body 2 may vary in diameter. A number of different toneholes are provided on the body 2. These include tonehole 10 having a diameter of 0.215 inches; toneholes 11 having diameters of 0.245 inches; toneholes 12 having a diameter of 0.296 inches; toneholes 13 having a diameter of 0.320 inches; toneholes 14 having a diameter of 0.342 inches; toneholes 15 having a diameter of 0.386 inches; and toneholes 16 having diameters of 0.425 inches; among others. It should be understood that in one embodiment, these diameters may have a deviation in size of +/−0.5%. In a particular embodiment, the toneholes may have the following diameters, in inches, with a deviation in size of +/−0.5%:

D#$^7$ trill.-0.245
D$^7$ trill-0.245
C#$^6$-0.215
C$^6$-0.296
B$^5$-0.296
A#$^5$-0.320
A$^5$ upper-0.320
A$^5$ lower-0.320
G#$^5$-0.320
G$^5$-0.342
F#$_5$-0.386
F$^5$-0.386
E$^5$-0.386
D#$^5$-0.425
D$^5$-0.425
C#$_5$-0.425
C$^5$-0.425

Further still, the present invention may comprise embodiments that have at least one of the tonehole positions and/or diameters as listed herein, without straying from the scope of this invention. In other words, some embodiments may have different positions of some of the holes, though in these embodiments as long as one tonehole is positioned as listed above, it will still be within the scope of this invention.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A piccolo comprising:

a cylindrical body having a cylindrical bore therethrough;

a headjoint removably attached to the cylindrical body, the headjoint having a conical bore, the conical bore having a same diameter as the cylindrical bore at a first end attaching to the cylindrical body, and a smaller diameter at an opposite end, the headjoint further defining an embouchure; and wherein the body further comprises a plurality of toneholes having the following respective distances from tonehole center from a lower end of the body, in inches:

D#$^7$ trill.-8.507
D$^7$ trill-8.161
C#$^6$-7.754
C$^6$-7.206
B$^5$-6.820
A#$^5$-6.390
A$^5$ upper-5.952
A$^5$ lower-5.511
G#$^5$-5.477
G$^5$-5.032
F#$^5$-4.498
F$^5$-3.966
E$^5$-3.424
D#$^5$-2.812
D$^5$-2.192
C#$^5$-1.591
C$^5$-0.877;

wherein the distance of each tonehole center from the end of the body having a distance tolerance of approximately +/−0.020 inches.

2. The piccolo of claim 1 wherein the plurality of toneholes have the following diameters, in inches:

D#$^7$ trill.-0.245
D$^7$ trill-0.245
C#$^6$-0.215
C$^6$-0.296
B$^5$-0.296
A#$^5$-0.320
A$^5$ upper-0.320
A$^5$ lower-0.320
G#$^5$-0.320
G$^5$-0.342
F#$^5$-0.386
F$^5$-0.386
E$^5$-0.386
D#$^5$-0.425
D$^5$-0.425
C#$^5$-0.425
C$^5$-0.425;

wherein the diameter of each of the plurality of toneholes may have a tolerance of +/−0.5%.

3. A piccolo having a range between B$^5$ to D#$^7$ comprising:

a cylindrical body having a cylindrical bore therethrough;

a headjoint removably attached to the cylindrical body, the headjoint having a conical bore, the conical bore having a same diameter as the cylindrical bore at a first end attaching to the cylindrical body, and a smaller diameter at an opposite end, the headjoint further defining an embouchure; and wherein the body further comprises a plurality of toneholes wherein at least one of the plurality of toneholes has a tonehole center at a distance a lower end of the body, in inches selected from the group consisting of:

D#$^7$ trill.-8.507
D$^7$ trill-8.161
C#$^6$-7.754
C$^6$-7.206
B$^5$-6.820
A#$^5$-6.390
A$^5$ upper-5.952
A$^5$ lower-5.511
G#$^5$-5.477
G$^5$-5.032
F#$^5$-4.498
F$^5$-3.966
E$^5$-3.424
D#$^5$-2.812;
D$^5$-2.192;
C#$^5$-1.591;
C$^5$-0.877;

wherein the distance of the at least one of the plurality of toneholes comprises tonehole center from the end of the body having a distance tolerance of approximately +/−0.020 inches.

4. The piccolo of claim 3 wherein the at least one of the plurality of toneholes has a diameter selected from the following diameters, in inches:

D#$^7$ trill.-0.245
D$^7$ trill-0.245
C#$^6$-0.215
C$^6$-0.296
B$^5$-0.296
A#$^5$-0.320
A$^5$ upper-0.320

$A^5$ lower-0.320
$G\#^5$-0.320
$G^5$-0.342
$F\#^5$-0.386
$F^5$-0.386
$E^5$-0.386
$D\#^5$-0.425
$D^5$-0.425
$C\#^5$-0.425
$C^5$-0.425;

wherein the diameter of the one of the plurality of tone-holes may have a tolerance of +/−0.5%.

* * * * *